United States Patent [19]

Sorbello et al.

[11] Patent Number: 4,929,959

[45] Date of Patent: May 29, 1990

[54] DUAL-POLARIZED PRINTED CIRCUIT ANTENNA HAVING ITS ELEMENTS CAPACITIVELY COUPLED TO FEEDLINES

[75] Inventors: Robert M. Sorbello, Potomac; John E. Effland, Gaithersburg; Amir I. Zaghloul, Bethesda, all of Md.

[73] Assignee: Communications Satellite Corporation, Washington, D.C.

[21] Appl. No.: 165,332

[22] Filed: Mar. 8, 1988

[51] Int. Cl.[5] ..... H01Q 00/00

[52] U.S. Cl. ..... 343/700 MS

[58] Field of Search ..... 343/700 MS, 767, 768, 343/769, 770, 829, 826, 778

[56] References Cited

U.S. PATENT DOCUMENTS

| | | | |
|---|---|---|---|
| 3,832,716 | 8/1974 | Plunk et al. | 343/770 |
| 4,083,046 | 4/1978 | Kaloi | 343/700 MS |
| 4,218,682 | 8/1980 | Yu | 343/700 MS |
| 4,263,598 | 4/1981 | Bellee et al. | 343/700 MS |
| 4,364,050 | 12/1982 | Lopez | 343/700 MS |
| 4,527,165 | 7/1985 | de Ronde | 343/778 |
| 4,737,793 | 4/1988 | Munson et al. | 343/700 MS |

FOREIGN PATENT DOCUMENTS

| | | | |
|---|---|---|---|
| 2090474 | 7/1982 | United Kingdom | 343/700 MS |

*Primary Examiner*—William L. Sikes
*Assistant Examiner*—Robert E. Wise
*Attorney, Agent, or Firm*—Sughrue, Mion, Zinn, MacPeak & Seas

[57] ABSTRACT

A printed-circuit antenna enabling two signals to be received simultaneously. Two layers of radiating elements and corresponding power dividers are provided, one set of power dividers being disposed orthogonally with respect to the other, so as to enable reception of two signals with orthogonal senses of polarization. Either dual linear or dual circular polarization may be achieved through suitable selection of radiating elements. Alternatively, a quadrature hybrid may be coupled, either externally or as an integral part of the antenna, to enable dual circular polarization.

20 Claims, 9 Drawing Sheets

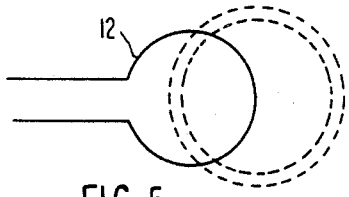
FIG. 5a
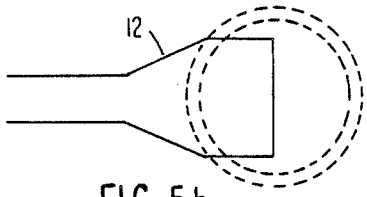
FIG. 5b
FIG. 5c
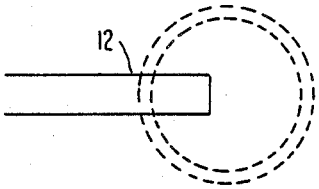
FIG. 6
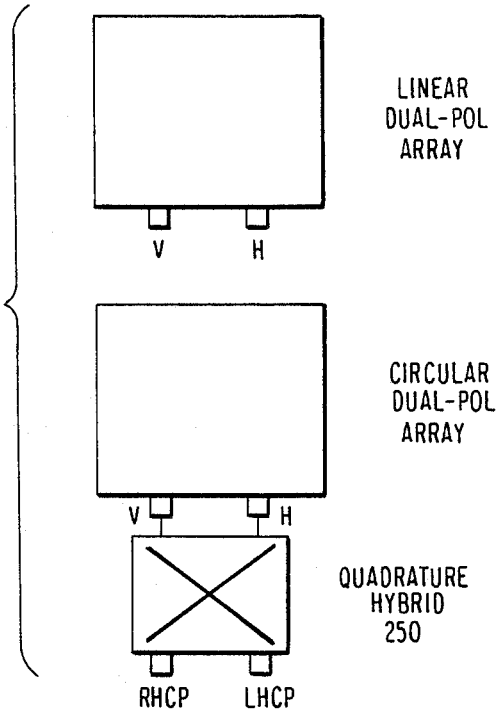

DUAL-POLARIZED PRINTED CIRCUIT ANTENNA HAVING ITS ELEMENTS CAPACITIVELY COUPLED TO FEEDLINES

BACKGROUND OF THE INVENTION

The present invention relates to a dual-polarized printed circuit antenna whose elements are capacitively coupled to feedlines. More specifically, the invention relates to a printed circuit antenna employing dual-polarization geometry having feedlines and radiating elements stacked one above the other with feedlines which are capacitively coupled to the radiating elements, such that no RF interconnection is required. By employing electromagnetic coupling in the power transfer from the distribution networks to the radiating elements, a high-performance, light weight, compact, low-cost dual polarized planar or conformal antenna is achieved.

Examples of previous work in the field of printed circuit antennas employing capacitive coupling made be found in currently co-pending U.S. Pat. Applications Ser. No. 748,637, filed June 25, 1985, now U.S. Pat. No. 4,761,654 and Ser. No. 930,187, filed November 13, 1986. These applications disclose printed circuit antennas employing capacitive coupling and enabling either linear or circular polarization, depending on the shape of the radiating and feeding elements (which may be patches or slots) which are used.

As shown in FIG. 1*a*, the ground plane 10, feedline 12, and feeding patch 14 are capacitively coupled. Alternative structures, employing radiating slots 16*b*, are shown in FIGS. 1*b* and 1*c* as well. The resulting structure is a light weight, low-cost, singly-polarized planar or conformal antenna capable of operating with either linear or circular polarization.

One limitation of this structure is that the antenna constructed according to the techniques disclosed in these co-pending applications can receive only one sense of polarization, either linear or circular, from a satellite. It is desirable to have a compact antenna structure which is capable of receiving both senses of polarization, so that twice as much information can be received.

One technique for achieving this desired result involves the provision of a dual-polarized antenna structure. However, because of problems inherent in the interaction among the various radiating elements and the power dividers in different layers in such a structure, it has not previously been possible to provide such an antenna.

SUMMARY OF THE INVENTION

In view of the foregoing deficiencies, it is an object of the present invention to provide a dual-polarized printed circuit antenna which has its elements capacitively coupled to feedlines, and which minimizes cross-coupling between the arrays.

It is a further object of the present invention to provide a printed circuit antenna which is capable of receiving both senses of polarization.

It is yet further object of the present invention to provide a dual-polarized antenna which does not require a direct probe to each radiating element for any of the senses of polarization provided in the antenna.

It is a still further object of the present invention to provide a dual-polarized printed circuit antenna which uses capacitive coupling from each power divider (corresponding to each polarization) to a respective radiating element.

In view of these objects, the present invention provides structure wherein two or more planar arrays of radiating elements are stacked one on top of the other, with appropriate numbers of power dividers disposed between consecutive layers of radiating elements. The power dividers may be disposed orthogonally with respect to each other, such that the antenna can receive two signals with opposite senses of polarization. The shape of the radiating elements may be such as to enable either linear or circular polarization to be achieved for each sense of polarization. Alternatively, a quadrature hybrid or other directional coupler may be employed with a dual polarized linear array to provide an equal power split and 90° phase between the two respective ports to develop a dual circularly polarized array.

The construction format of the present invention yields much lower dissipative loss than has been observed previously in most conventional flat planar arrays which incorporate a transmission medium such as microstrip.

BRIEF DESCRIPTION OF THE DRAWINGS

The present invention now will be described with reference to the accompanying drawings, in which:

FIGS. 5*a*–5*f* show alternative structures for the feedline which feeds the radiating elements of the array of the antenna of FIG. 2;

FIG. 6 shows a view of a quadrature hybrid which may be used in conjunction with the inventive antenna to provide dual circlar polarization with a dual-polarized linear array.

DETAILED DESCRIPTION OF A PREFERRED EMBODIMENT

Figure 1A:
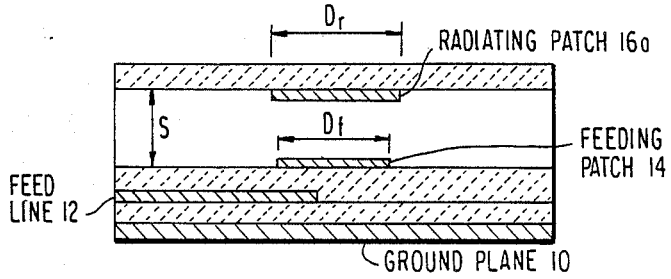
FIGS. 1*a*–1*c* show cross-sections of structure for a known single-polarized antenna disclosed in the above-mentioned co-pending applications.
Figure 1B:
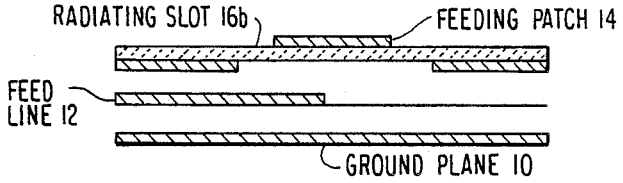
Figure 1C:
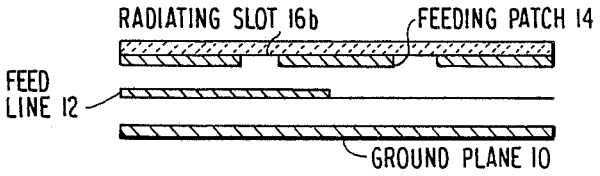
Figure 2:
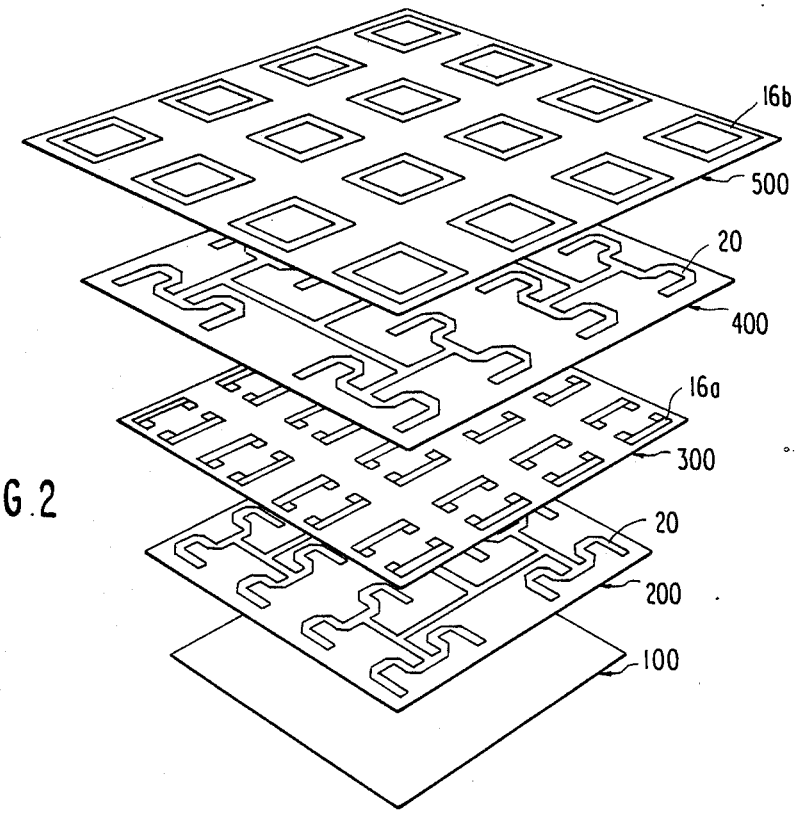
FIG. 2 shows a blown-up view of the dual-polarization geometry in the printed circuit antenna of the present invention.

FIG. 2 is a blown-up depiction of an example of the dual-polarization geometry of the antenna of the present invention. Shown in the figure are ground plane 100, a first power divider 200, a first sheet of radiating elements 300, a second power divider 400 which may be disposed orthogonally to the first power divider, and a second sheet of radiating elements 500. The radiating elements on the sheets 300 and 500 may comprise patches or slots. Examples of suitably-shaped radiating elements are shown in FIGS. 3*a*–3*l* and 4*a*–4*f*.

The elements shown in the antenna of FIG. 2 are linear elements. These also may be used in a circularly-polarized array by means of a quadrature hybrid 250, which is shown in FIG. 6. Alternatively, the elements may be intrinsically circularly polarized and configured as shown in FIG. 4*a*–4*f*, wherein notches 18*a* or tabs 18*b* are provided on the elements.

In construction, the layers shown in FIG. 2 are appropriately spaced and stacked one over the other with no interconnects between the radiating elements. Spacing is in accordance with the wavelength of electromagnetic radiation λ which is being received. One such spacing may be, for example, λ/10; other spacings may be provided as appropriate, but of course would require different optimization of the elements in the various layers, as is known to those working in the relevant art.

All feeding to all the elements in the array of FIG. 2 is done by capacitive coupling. Essentially two arrays are formed. A first array having a first sense of polarization is formed by ground plane 100, power divider 200 having power divider elements 20, and element board 300. In this array, the layers 100 and 300 form the ground plane for the power dividers, and layer 300 also contains the printed radiating elements.

A second sense of polarization is formed by layers 300, 400 and 500, wherein the layers 300 and 500 provide the ground plane for the power divider 400 having power divider elements 20, and layer 500 contains the printed radiating elements.

The element designs on layers 300 and 500 are selected appropriately to minimize both radiation interaction between the lower and upper arrays, and cross-talk between the two power distribution networks. It should be pointed out that there tends to be a natural interaction between the networks in layers 200 and 400, shown in FIG. 2. The metal portion of the layer 300 thus acts as isolation to prevent the two networks from "talking to each other", a phenomenon known as cross-talk. It is important to minimize cross-talk in order to maximize the independence of operation of the arrays.

Figure 3A:
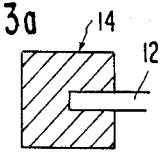
FIGS. 3*a*–3*l* show examples of shapes of radiating elements which may be used in the antenna of FIG. 2 to achieve linear polarization.
Figure 3B:
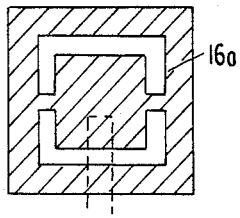
Figure 3C:
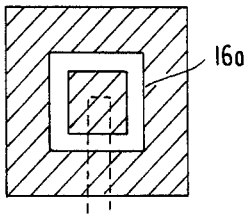
Figure 3D:
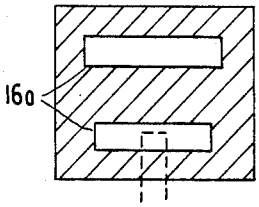
Figure 3E:
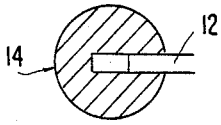
Figure 3F:
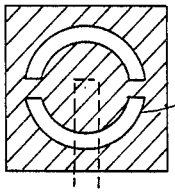
Figure 3G:
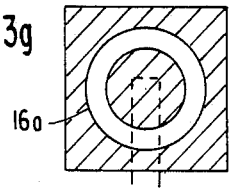
Figure 3H:
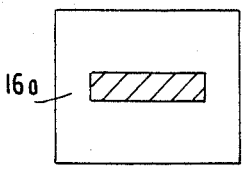
Figure 3I:
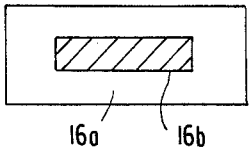
Figure 3J:
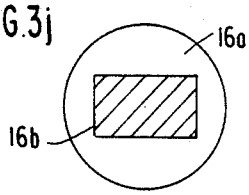
Figure 3K:
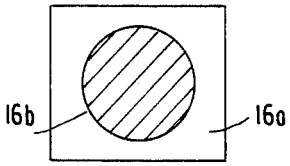
Figure 3L:
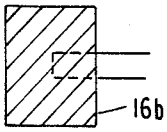
Figure 4A:
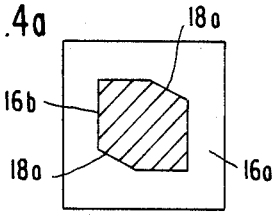
FIGS. 4*a*–4*f* show examples of shapes of radiating elements which may be used in the array of the antenna of FIG. 2 to achieve circular polarization.
Figure 4B:
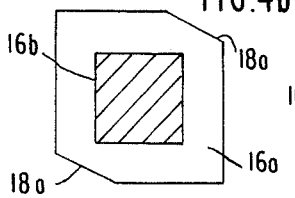
Figure 4C:
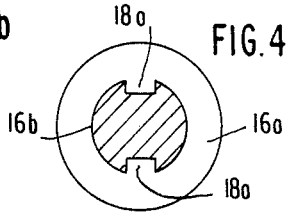
Figure 4D:
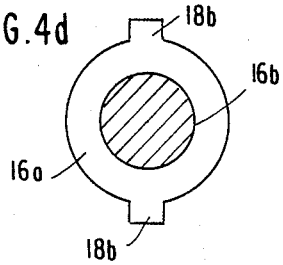
Figure 4E:
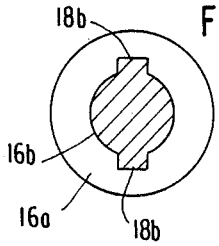
Figure 4F:
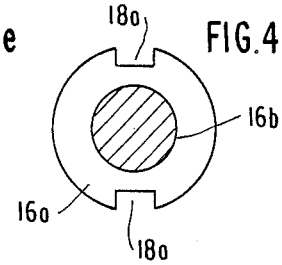

To improve this isolation, the elements in the layer 300 may differ slightly from the elements in the layer 500. More specifically, additional metallization is provided along a line in each of the elements in the layer 300, so that the radiating slots 16*a* which are shown in the layer 300 essentially comprise two U-shaped slots. In the limit, the radiating slots may comprise two parallel slots, as shown in FIG. 3*d*.

Another consideration is that the size of the inner portion of the slots 16*b* in the elements of layer 500 affects how much energy is blocked to the bottom array. If the layer 500 has shapes that are too big, the first array comprising layers 100, 200 and 300 may not be able to "see through" the layers 400 and 500, so that those layers would not be transparent with respect to energy transmitted to that bottom array.

More specifically with respect to the particular construction of the elements in the layer 500, the squares in the slot 16*b* are similar to what is disclosed in copending application Ser. No. 930,187. The layer 300 also may have shapes similar to that in application Ser. No. 930,187, but as mentioned above, there is a little additional metallization as shown to form two U-shaped shapes out of the square.

Basically, the elements in the sheet 300 are essentially the same as those in the sheet 500 to start with. However, the lines in the power divider sheet 400 need metal underneath where those lines go underneath the elements in the sheet 500. Accordingly, part of the slot or layer in the elements 300 is covered up with metal, resulting in the two U-shaped pieces shown in FIG. 2. The dual-polarization geometry of the present invention enables the two arrays to operate substantially independently of each other.

The feedlines 12 which feed the radiating elements in the sheets 300 and 500 may have any suitable shape. For example, as shown in FIG. 5*a*–5*c*, the end of the feedline 12 which is capacitively coupled to a respective radiating element may be paddle shaped (FIG. 5*a*); wider at one end than at the other (FIG. 5*b*); or simply straight (FIG. 5*c*).

All the layers shown in FIG. 2 are separated by a suitable dielectric. Air presently is preferred as a dielectric, with a suitable honeycomb structure being provided among the layers to provide physical separation, as is well known to those of working skill. Polyethylene, Duroid TM, nomex, or Teflon TM also may be used. However, it should be noted that, depending on the dielectric used, efficiency of the antenna could be degraded, as dielectrics tend to be lossy at microwave frequencies.

The operation of the dual-polarized array shown in FIG. 2 is as follows. As mentioned above, what is shown is dual linear polarization, which is dictated by the radiating elements. The two arrays of elements are fed orthogonally, such that one array will radiate either vertical or horizontal polarization, and the other array will radiate correspondingly horizontal or vertical polarization. One way of obtaining circular polarization was described above, with reference to FIG. 4*a*–4*f*. However, as shown in FIG. 6, it may be possible to achieve dual circular polarization by having a quadrature hybrid at the input of the array. A quadrature hybrid 250, as shown in FIG. 6, is essentially a directional coupler which is well-known in the art, and need not be described in detail here. However, it should be noted that the quadrature hybrid is connected to the arrays such that the two output ports of the hybrid feed the vertical and horizontal ports of the array, respectively. The input ports of the hybrid then would correspond to right-hand and left-hand polarization, respectively. Such a quadrature hybrid provides inherent isolation so as to allow both senses of polarization to operate simultaneously. The hybrid 250 may be implemented as an external component, or may be integrated directly into the array.

Figure 7:
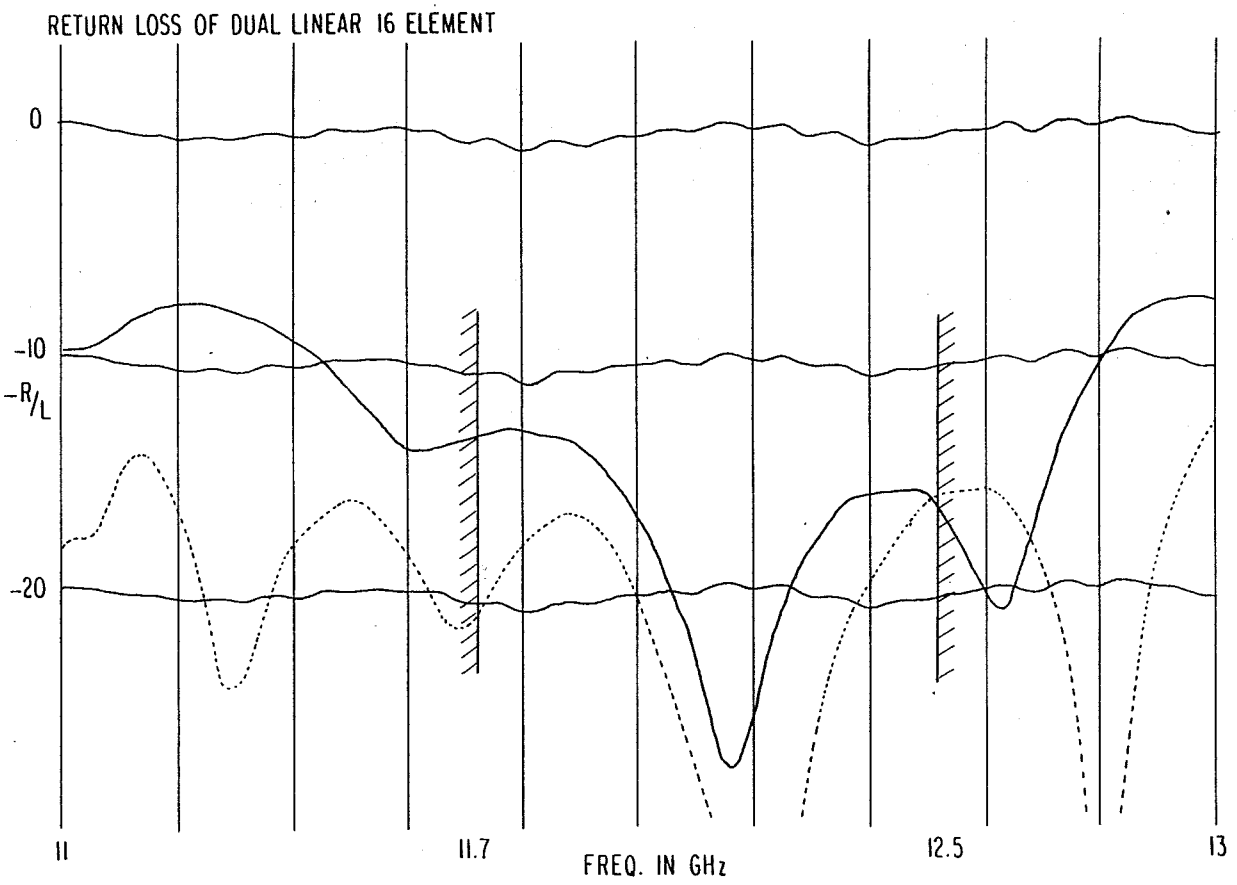
FIGS. 7–12 show examples of the results achieved with the antenna of the present invention.

FIGS. 7–11 show results achieved with an example of the inventive dual polarized linear array employing 16 elements. FIG. 7 shows the input return loss for both senses of polarization. It should be noted that the figure shows very good input match over a broad band.

Figure 8:
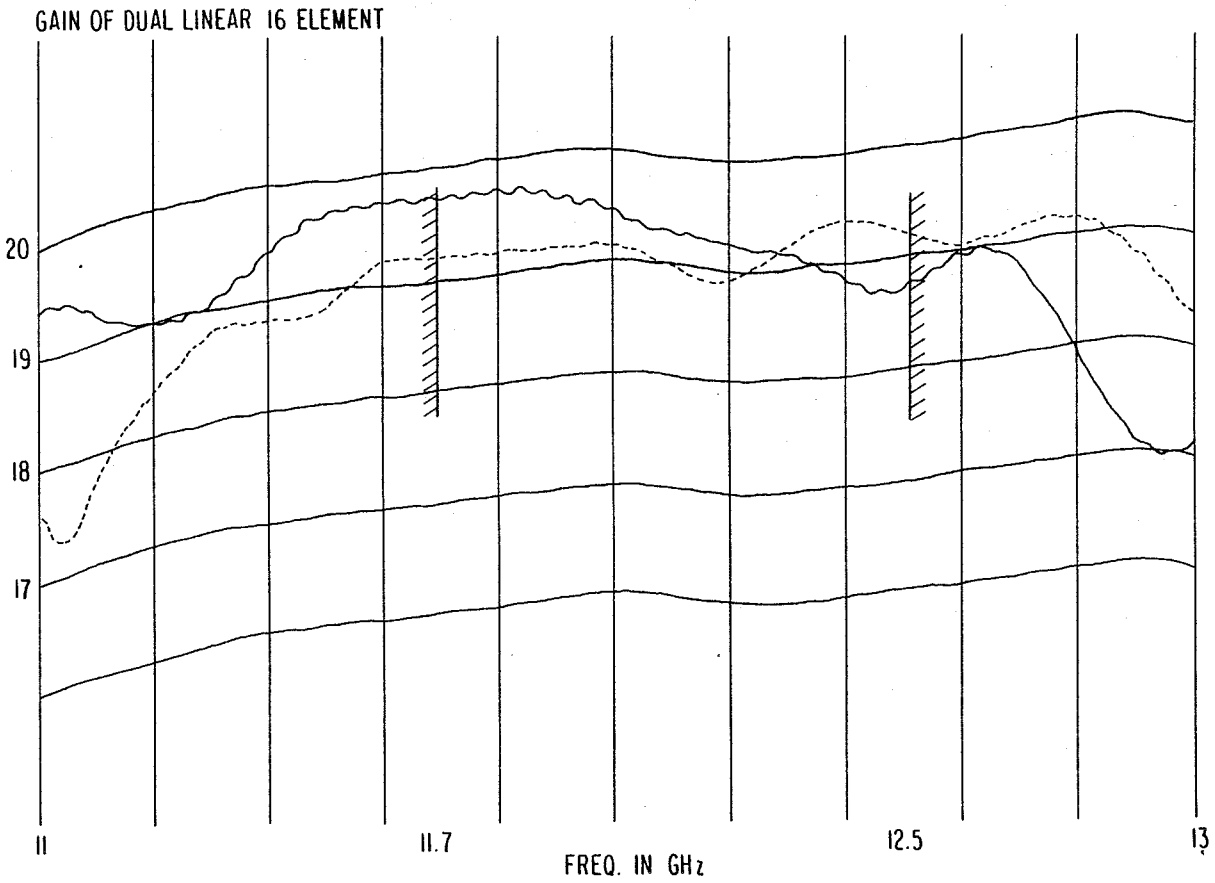

FIG. 8 shows the corresponding radiation gain for each polarization, and shows very efficient radiation over a broad band for both senses of polarization. The radiation efficiency of each of the arrays appears comparable.

Figure 9:
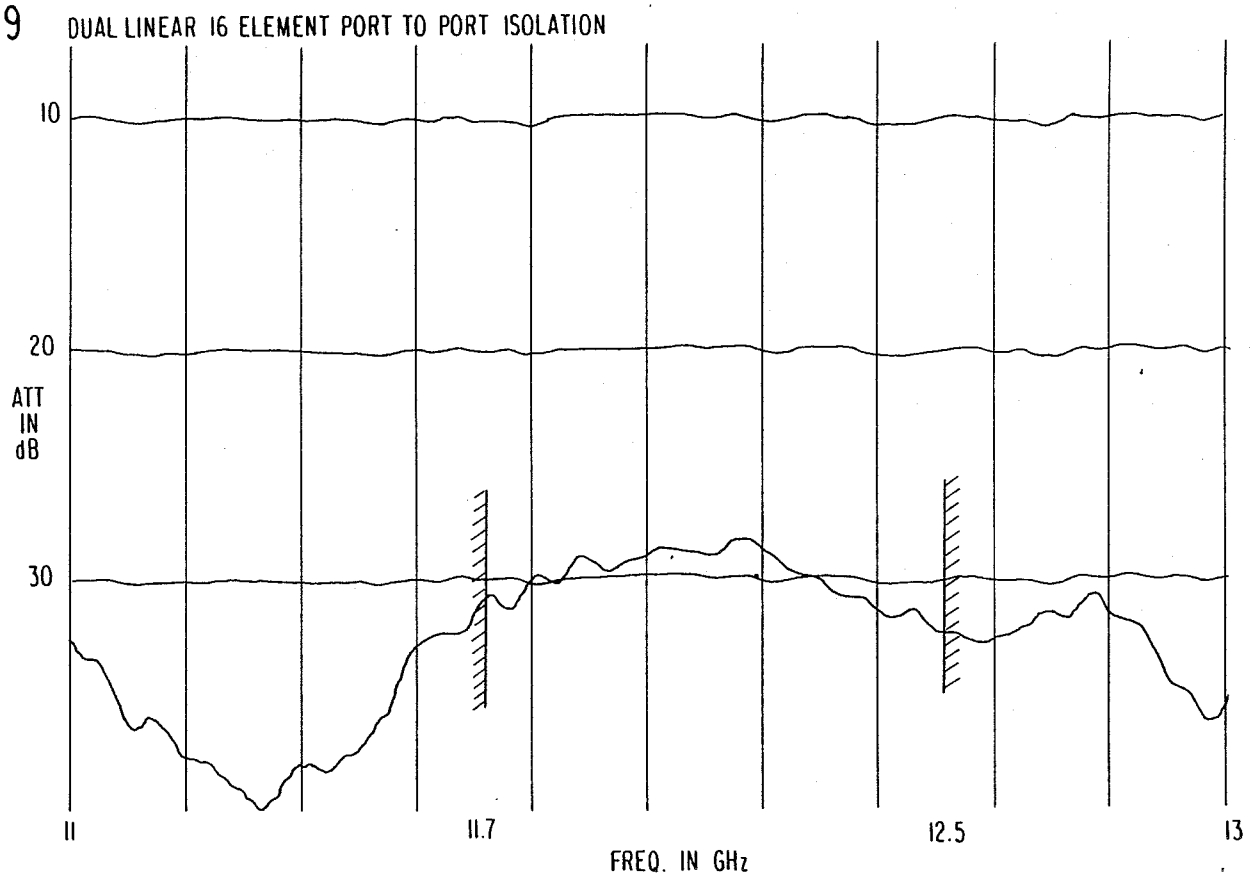

FIG. 9 shows array network isolation. The two arrays are virtually decoupled, and operate as required in an independent manner, as shown in this graph.

Figure 10:
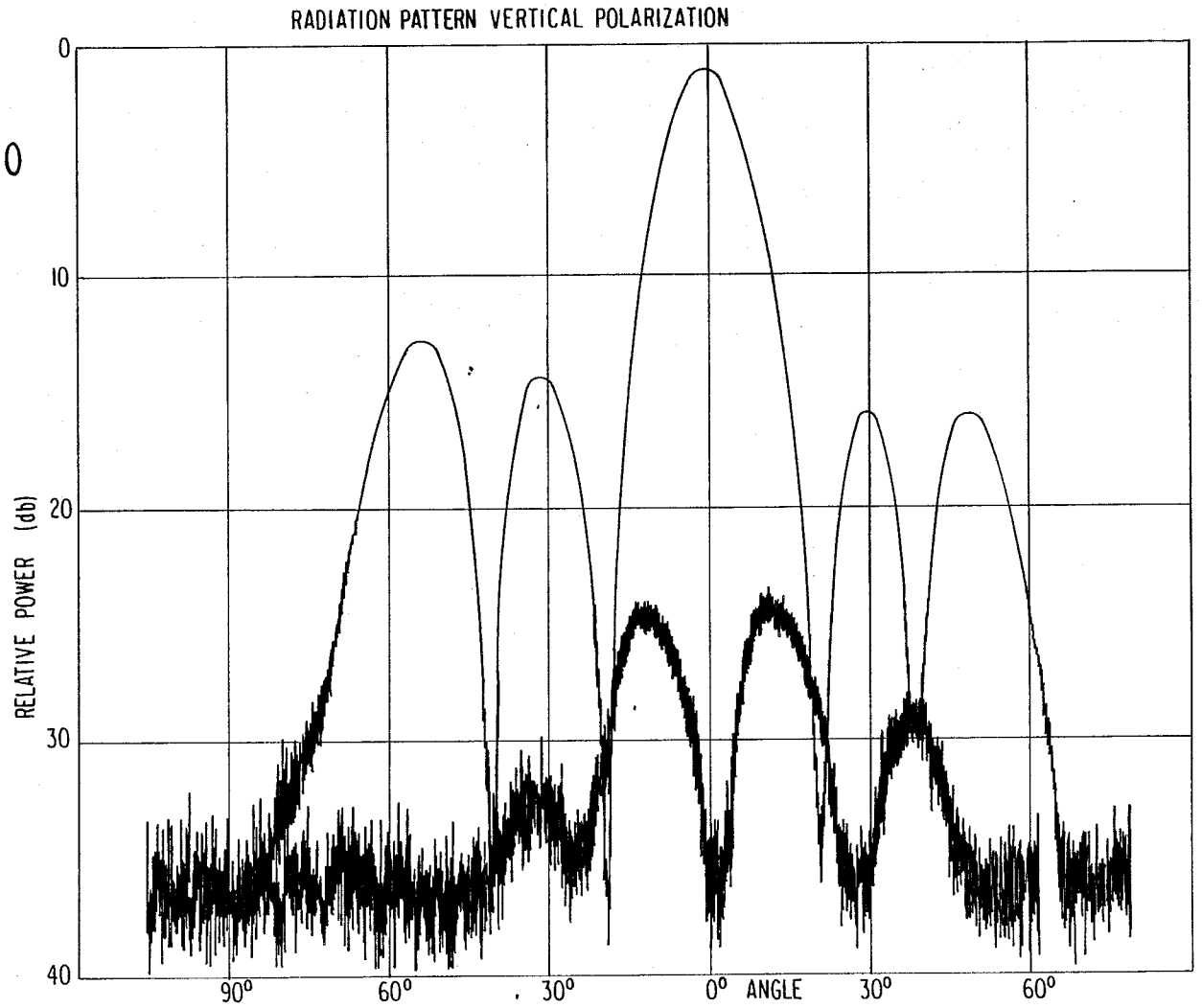
Figure 11:
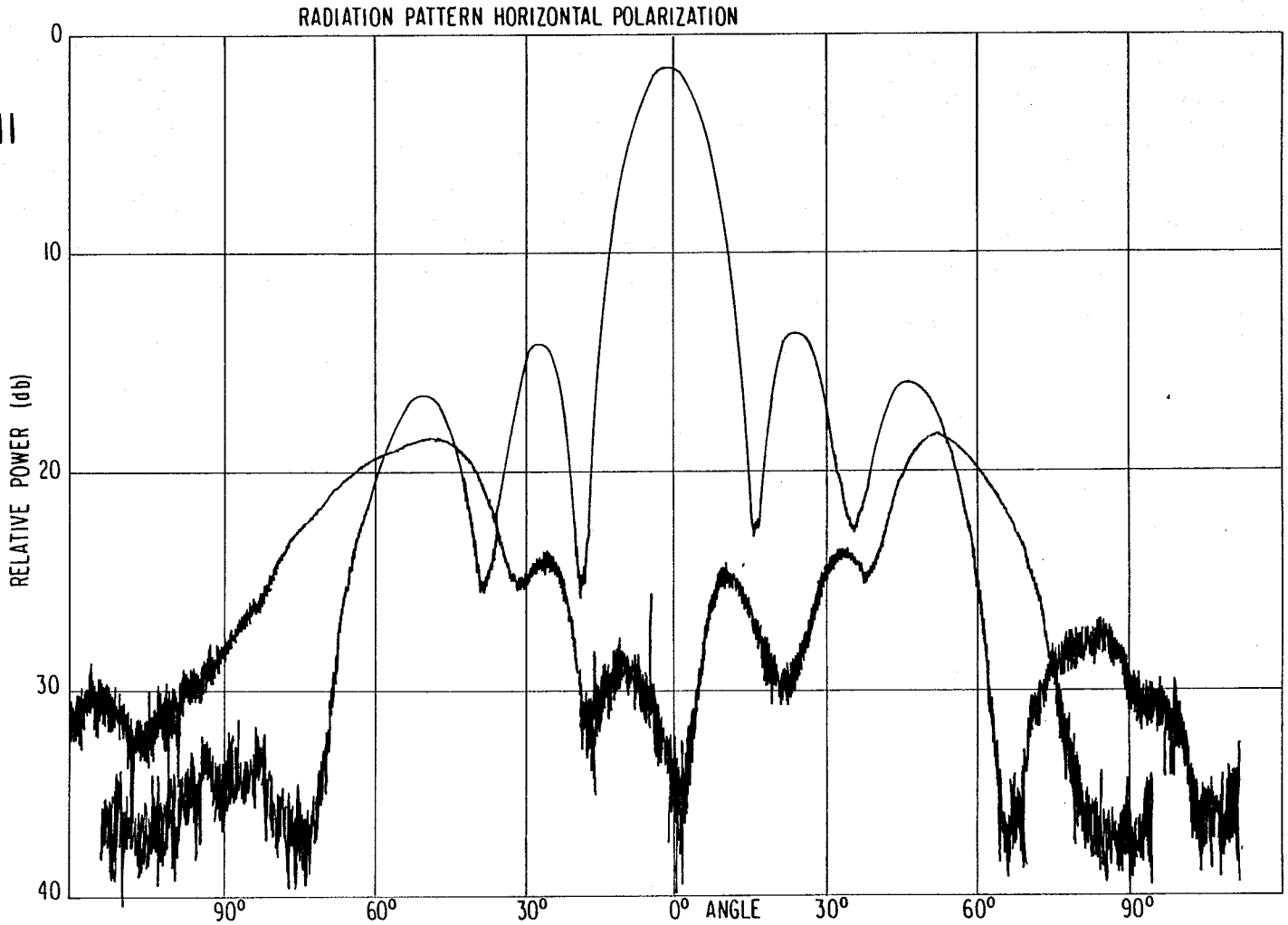

FIGS. 10 and 11 show corresponding radiation patterns for each sense of polarization. The figures demonstrate the efficiency of the radiating array, and the low radiated cross-polarization.

Figure 12:
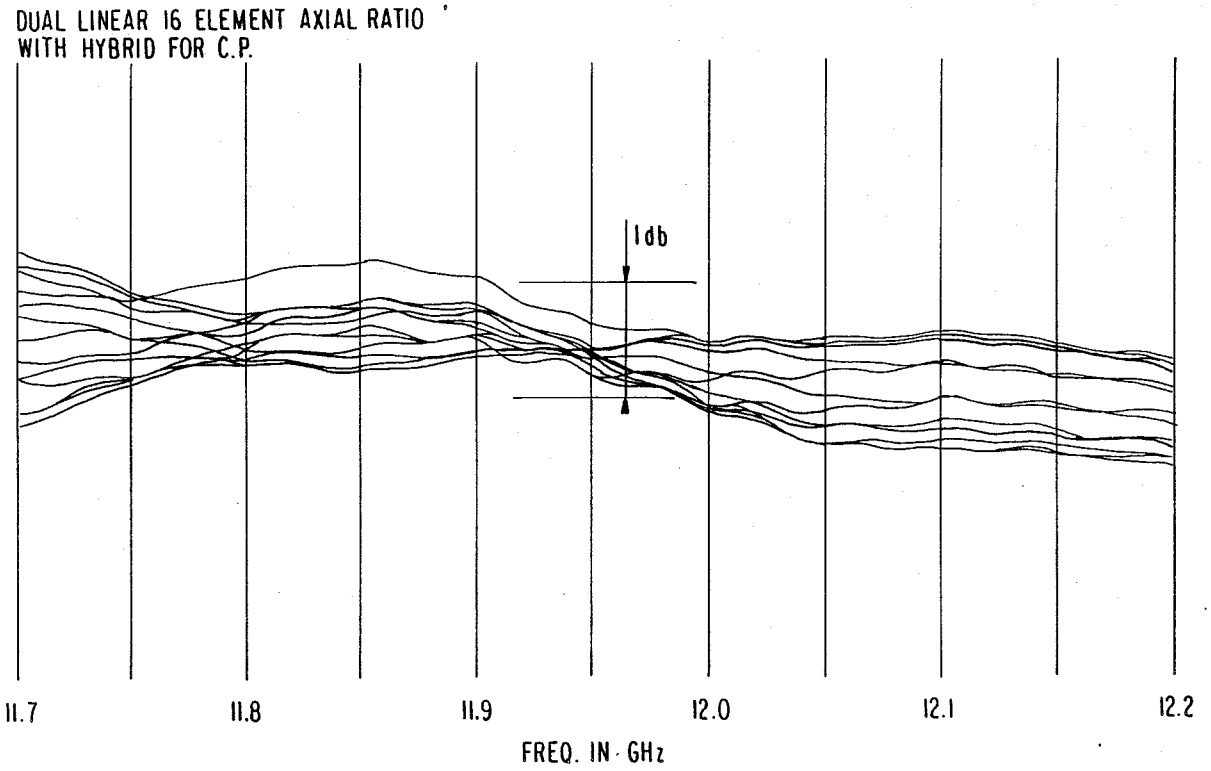

FIG. 12 shows an example of the mapping of the dual-polarization linear to dual-polarization circular by a quadrature hybrid. To achieve the results shown in this figure, the 16 element array which was the subject of the experiment was converted to circular polarization by placing an external quadrature hybrid on the vertical and horizontal ports of the array. FIG. 12 shows the resultant measured axial ratio, and demonstrates that good circular polarized performance can be achieved over a large bandwidth.

It should be understood that although the data shown in FIGS. 7–12 was achieved for a specific frequency band, the invention is not so limited. Rather, what has been described as a dual-polarized antenna design that can be implemented at any frequency and for any size array, or for any number of elements. Thus, it should be understood that the invention is not to be limited by the description of the foregoing embodiment, but should be considered as limited only by the appended claims which follow immediately.

What is claimed is:

1. A dual-polarized printed circuit antenna comprising:

a ground plane;

a first power divider array disposed over said ground plane;

a first array of radiating elements disposed over said first power divider array;

a second power divider array disposed over said first array of radiating elements; and a second array of radiating elements disposed over said second power divider array;

wherein said first power divider array and said first array of radiating elements are capacitively coupled to each other, and said second power divider array and second array of radiating elements are capactively coupled to each other.

2. A dual-polarized printed circuit antenna according to claim 1, wherein each of the radiating elements in said second array of radiating elements comprise slots, and each of the elements in said first array of radiating elements comprise slots with sufficient metallization added to divide each element within said first array of radiating elements into two U-shaped portions.

3. A dual-polarized printed circuit antenna according to claim 2, wherein said metallization is sufficient to divide each element within said first array of radiating elements into two parallel rectangular portions.

4. A dual-polarized printed circuit antenna as claimed in claim 3, wherein said metallization is added where portions of said second power divider array pass underneath corresponding elements in said second array of radiating elements, so as to minimize cross-talk.

5. A dual-polarized printed circuit antenna as claimed in claim 2, wherein all of said slots are square-shaped.

6. A dual-polarized printed circuit antenna as claimed in claim 2, wherein all of said slots are circular in shape.

7. A dual-polarized printed circuit antenna as claimed in claim 2, wherein said metallization is added where portions of said second power divider array pass underneath corresponding elements in said second array of radiating elements, so as to minimize cross-talk.

8. A dual-polarized printed circuit antenna as claimed in claim 1, wherein said first and second arrays of radiating elements comprise radiating slots with notches added thereto so as achieve circular polarization.

9. A dual-polarized printed circuit antenna as claimed in claim 1, wherein said first and second arrays of radiating elements comprise radiating slots with tabs added thereto so as achieve circular polarization.

10. A dual-polarized printed circuit antenna as claimed in claim 1, wherein said first and second arrays of radiating elements comprise radiating patches.

11. A dual-polarized printed circuit antenna as claimed in claim 10, wherein said radiating patches have notches added thereto so as achieve circular polarization.

12. A dual-polarized printed circuit antenna as claimed in claim 10, wherein said radiating patches have tabs added thereto so as achieve circular polarization.

13. A dual-polarized printed circuit antenna as claimed in claim 10, wherein all of said patches are square-shaped.

14. A dual-polarized printed circuit antenna as claimed in claim 10, wherein all of said patches are circular in shape.

15. A dual-polarized printed circuit antenna as claimed in claim 14, wherein said dielectric is air.

16. A dual-polarized printed circuit antenna as claimed in claim 1, further comprising a quadrature hybrid connected to respective inputs of said antenna, so as to achieve two independent senses of circular polarization.

17. A dual-polarized printed circuit antenna as claimed in claim 1, wherein said second power divider array has its elements disposed at a different angular orientation than the elements of said first power divider array.

18. A dual-polarized printed circuit antenna as claimed in claim 1, wherein said second power divider array has its elements disposed orthogonally with respect to elements of said first power divider array, such that senses of polarization achieved by said antenna are mutually orthogonal.

19. A dual-polarized printed circuit antenna as claimed in claim 1, wherein all of said ground plane, said first and second power divider arrays, and said first and second arrays of radiating elements are mutually separated by a suitable dielectric selected from the group consisting of air, polyethylene, Duroid TM, nomex, and Teflon TM.

20. A dual-polarized printed circuit antenna as claimed in claim 1, wherein said first array of radiating elements and said first power divider array, together with said ground plane, form a first antenna array having a first sense of polarization, and wherein said second array of radiating elements and said second power divider array, together with said first array of radiating elements, form a second antenna array having a second sense of polarization orthogonal to said first sense of polarization.

* * * * *